US005685182A

United States Patent [19]

Chhatwal

[11] Patent Number: 5,685,182

[45] Date of Patent: Nov. 11, 1997

[54] DOOR HANDLE-MOUNTED EUROCYLINDER-TYPE ASSEMBLY FOR ELECTRONIC LOCK AND KEY SYSTEM

[75] Inventor: KN Singh Chhatwal, Melbourne, Fla.

[73] Assignee: Intellikey Corporation, Melbourne, Fla.

[21] Appl. No.: 442,003

[22] Filed: May 16, 1995

Related U.S. Application Data

[63] Continuation-in-part of Ser. No. 184,024, Jan. 21, 1994, Pat. No. 5,507,162, which is a continuation-in-part of Ser. No. 596,210, Oct. 11, 1990, Pat. No. 5,337,588.

[51] Int. Cl.[6] ..... E05B 13/10

[52] U.S. Cl. ..... 70/224; 70/278; 70/283; 292/144; 292/356; 292/357

[58] Field of Search ..... 70/224, 277–283; 292/144, 356, 357

[56] References Cited

U.S. PATENT DOCUMENTS

| | | | |
|---|---|---|---|
| 2,105,304 | 1/1938 | Wagner | 70/277 |
| 3,967,846 | 7/1976 | Schlage | 70/283 X |
| 4,504,087 | 3/1985 | Pennington | 292/347 |
| 4,655,059 | 4/1987 | Best et al. | 292/347 X |
| 5,018,375 | 5/1991 | Tully | 70/283 X |
| 5,398,531 | 3/1995 | Shen | 70/224 |

FOREIGN PATENT DOCUMENTS

| | | | |
|---|---|---|---|
| 0190884 | 7/1989 | Japan | 70/277 |
| 2024922 | 1/1980 | United Kingdom | 70/277 |

*Primary Examiner*—Lloyd A. Gall
*Attorney, Agent, or Firm*—Charles E. Wands

[57] ABSTRACT

A handle-operated lock and latch assembly for interfacing a Eurocylinder type of electronic lock with a rose-accessible door lock/latch mechanism employs a handle of the type used in a mechanical handle-actuated door latch, but in which the shank portion of the handle is modified to include a cavity that accommodates a Eurocylinder-configured electronic lock. The original rose is replaced by a rose having a slightly larger circular aperture, so that it may receive a rotatable collar that is configured to engage the modified handle shank, whereby the handle and the collar are rotatable relative to the rose, with the cam of the electronic lock being inserted into the door's existing lock spindle mechanism. In addition to physically interfacing the modified handle with the rose, the collar provides an annular passageway that accommodates a flex circuit ribbon extending from the electronic lock through the collar and the rose for electrical connection between the electronic lock and control circuitry external to the lock. The flex circuit ribbon has a segmented meandering shape, that allows it to form a loop around the lock spindle, which is capable of expanding and contracting around the lock spindle as the handle and collar rotate relative to the rose during operation of the door latch.

20 Claims, 6 Drawing Sheets

DOOR HANDLE-MOUNTED EUROCYLINDER-TYPE ASSEMBLY FOR ELECTRONIC LOCK AND KEY SYSTEM

CROSS-REFERENCE TO RELATED APPLICATIONS

The present application is a continuation-in-part of application Ser. No. 08/184,024 (hereinafter referred to as the '024 application), filed Jan. 21, 1994, now U.S. Pat. No. 5,507,162, issued Apr. 16, 1996, entitled "Eurocylinder-Type Assembly for Electronic Lock and Key System," by KN Singh Chhatwal, assigned to the assignee of the present application and the disclosure of which is herein incorporated, which application is, in turn, a continuation-in-part of earlier filed application Ser. No. 07/596,210, filed Oct. 11, 1990, entitled "Electronic Lock and Key System," by KN Singh Chhatwal, now U.S. Pat. No. 5,337,588, issued Aug. 16, 1994, also assigned to the assignee of the present application and the disclosure of which is herein incorporated.

FIELD OF THE INVENTION

The present invention relates in general to electronic key and lock systems, and is particularly directed to a new and improved lock/latch assembly for a electronic lock, that is configured to conform with what is commonly known in the industry as a 'Eurocylinder' type of lock and which is installable in a modified handle of the type customarily used in a rose-mounted, lever-operated door latching mechanism.

BACKGROUND OF THE INVENTION

The above-referenced U.S. Pat. No. 5,337,588 describes an electronic lock and key system, in which each of respective lock and key devices is provided with its own on-board intelligence (control processor and associated memory). In this patented system, the lock supplies power for each of the lock and the key, and communications between the lock and the key are effected by means of a secure bidirectional optical (infrared) communication link. An example of an electronic lock and key system with which the lock and key components described in my above-referenced co-pending application has particular utility is described in co-pending application Ser. No. 843,988, by C. Malinowski et al, which is a continuation of application Ser. No. 596,100, filed Oct. 11, 1990, assigned to the assignee of the present application and the disclosure of which is herein incorporated.

A widely employed lock hardware configuration where the functionality of such a dual intelligence lock and key system is desirable is a 'Eurocylinder' lock design, prevalent in residential buildings, offices and hotels throughout Europe. According to the 'Eurocylinder' standard, the lock hardware has a cylindrical unit or plug that is fitted into a main body housing. The main body is configured to be mounted into a support structure cavity, such as a mortise, of standardized dimensions. The cylindrical plug and body are mounted to be generally flush with the support structure (e.g. door mortise). The plug has a keyway at one end and a lock operating element (in the form of a deadbolt-engaging cam) at the other end. To operate the lock, the blade of a mechanical key whose key pattern matches the actuator pattern of the lock's keyway is inserted into the keyway and the key is rotated. Rotating the key turns the cylinder and cam, and moves the deadbolt.

Advantageously, the invention described in the above-referenced '024 application provides an electronic lock architecture that incorporates the novel features of the electronic lock and key described in the '588 patent, but in a configuration that conforms with a 'Eurocylinder' type of lock, so that it may be used as a replacement for mechanical Eurocylinder type locks, without having to modify the mounting receptacle for the substituted unit.

The Eurocylinder configuration described in my co-pending '024 application is diagrammatically illustrated in FIGS. 1, 2 and 3 as comprising a Eurocylinder-shaped metallic housing 10 having a generally cylindrical body portion 13, and a generally elongated curvilinear portion 15, that extends from a side portion of the cylindrical body portion 13. The cylindrical body portion 13 has a first, generally cylindrical longitudinal bore 21 that is configured to accommodate a generally cylindrical rotatable plug 20. Plug 20 has a keyway 25 into which an electronic key 30 is insertable for operating the lock. If the inserted key 30 has been electronically verified to have permission to operate the lock, the plug 20 is rotated by turning the key, which causes corresponding rotation of a deadbolt-engaging cam 33 mounted solid with an interior end 35 of the plug. The cam 33 is accommodated within a cavity 41 that extends from a sidewall 43 portion of the cylindrical portion 13 of the body to a prescribed depth of its interior surface 45 in the elongated curvilinear portion 15.

An arcuate recess 37 formed in the interior surface of the front end of the bore 21 accommodates an insulating contact holder 39. The contact holder 39 has a depression 40, receiving a fixed metallic contact that serves as a conductive interface between a translatable contact 42 and a flex circuit termination 44, so that an electrical circuit path may be provided between a flex circuit section 49 and a raised terminal 46 insulated via dielectric region 48 from a key-blade 31.

The Eurocylinder-configured body 10 further includes a generally cylindrical third cavity 51 that extends from a generally flat land portion 53 at the bottom of a depression 55 extending from bottom surface portion 57 in elongated curvilinear portion 15. The depression 55 is enclosed by a cover 56. The third cavity 51 communicates with the first cavity 21 and accommodates the insertion of a cylindrical solenoid device, shown at 61. Solenoid device 61 has a longitudinal hollow core 62 surrounded by a winding 68. Energizing current for winding 68 is supplied by way of a pair of electrical terminals that are electrically coupled to respective links of a flex circuit 91. Slidably translatable within solenoid bore 62 is a movable plunger 63 that is translatable along a bore axis 65, which intersects bore 21 in the cylindrical body portion 13.

The bottom of cavity 51 has a reduced diameter cylindrical bore 71 that is sized to receive a bottom portion 69 of solenoid device 61. Cylindrical plug 20 has a further bore 72 that receives solenoid plunger 63 and has a longitudinal axis 75 that is alignable with axis 65 of the solenoid. Plunger 63 is normally mechanically biased by a compression spring 67 that rides on a stem 64 of plunger 63 and is fitted between a rear surface 66 of plunger 63 and the bottom interior surface 81 of the longitudinal cylindrical core 62 of solenoid device 61. In the absence of the energizing current applied to solenoid winding 68, spring 67 normally biases plunger 63 into the bore 72 of the cylindrical plug 20, and thereby prevents rotation of the plug 20 and its associated cam 33. In order for the plug 20 to rotate within bore 21, the solenoid winding 68 must be energized, thereby translating plunger 63 out of the bore 72 in plug 20.

The elongated portion 15 of the cylinder body 10 further includes a fourth bore 101 that extends generally transversely from the land portion 53 of depression 55 and intersects bore 21. Bore 101 is alignable with a bore 111 in the generally cylindrical body portion 13. Disposed within and translatable along an axis 102 of bore 101 is a pin 105 that is biased by a compression spring 107, that is seated between a cylindrical retaining pin 104 and an end surface 116 of pin 105, toward the bore 21 in which cylindrical plug 20 is inserted. Retaining pin 104 is press fit into bore 101, so that its bottom surface 108 is flush with land 53 of depression 55. Extending from the bottom surface 108 of retaining pin 104 is a grounding post 110, that fits in a corresponding hole in flex circuit 91 and provides both a circuit ground and anchors the flex circuit 91 at that point.

The bore 111 in plug 20 extends through the cylindrical sidewall 26 of the plug 20 to a prescribed depth in the keyway 25. Bore 111 also contains a pin 113. The length of pin 113 is such that, when the key is properly inserted in the keyway 25 in the position shown in FIG. 1, bore 111 in plug 20 is axially aligned with bore 101 of elongated body portion 15, and a rounded head portion 121 of the pin 113 is captured within a detent 123 in keyblade 31, on the one hand, and a second flat end portion 125 of pin 113 is flush with the outer cylindrical surface 127 of plug 20 and an end surface 114 of pin 105. When the flat end portion 125 of pin 113 is flush with the outer cylindrical surface 127 of plug 20, the plug 20 can be rotated in bore 21.

When the key 30 and plug 20 are rotated from this aligned, insertion position, the key cannot be removed, since the second flat end portion 125 of the pin 113 is no longer in axial alignment and flush with the end surface 114 of pin 105. Only when the key 30 and plug 20 are rotated into the insertion position shown in FIG. 1, can the key be removed, since it is in this position that the second flat end portion 125 of the pin 113 is in axial alignment and flush with the end surface 114 of pin 105, so that, as the key is pulled out of the keyway, the rounded head portion 121 of pin 113 is moved axially in bore 111 by contact pressure of keyblade detent 123. The pressure of pin 113 against pin 105 compresses spring 107 and allows pin 113 to ride up into bore 111, so that the rounded head portion 121 may clear the keyblade detent 123, whereby the key can be extracted. When the key is removed from the keyway 25, pin 113 drops back down to a position determined by the depth of bore 111 in plug 20.

A front end portion of the elongated portion 15 of body 10 includes a fourth cavity that is configured to receive an opto-electronic communication unit having a pair of opto-electronic transmit and receive devices, shown as an infrared transmitter module 151 and an infrared receiver module 153, which are fit into respective bores of a solid body endwall 165. Modules 151 and 153 are operative to communicate with mutually aligned receive/transmit modules 161, 163 of an opto-electronic communication unit contained within a handle portion 36 of the key 30. Electrical connections to opto-electronic modules 151 and 153 are provided by way of terminal posts 171, 173 and 181, 183 respectively, which extend from a rear face 146 of body endwall 165 and attach to respective conductor tracks of flex circuit 91. Lenses 156 and 157 are disposed in front face portion of endwall 165, adjacent to modules 151 and 153.

The rear face 146 of endwall 165 opens into a cavity 172 that is sized to accommodate the insertion of the multi-conductor flex circuit 91, and also a flexible conductive link segment (not shown in FIG. 1) which is connected to one of the conductors of the flex circuit 91. Cavity 172 adjoins depression 55, so as to provide an unobstructed path (shown in FIG. 1 as having a right angle turn 58) through which flex circuit 91 may extend. Flex circuit 91 exits body 10, by way of a channel 191 in the end surface portion 57 of elongated curvilinear portion 15, for connection to an external lock control circuit. Stainless steel pins 185, 186 and 187 serve to prevent physical tampering (e.g. drilling) with the internal components of the lock.

As shown in FIGS. 2 and 3, the keyway 25 has conventional guide ridges 201, 202 and 203 with which corresponding grooves on the keyblade 31 of key 30 must conform. Plug 20 also has a generally cylindrical bore 204 having an axis 206 that is generally transverse to the longitudinal axis of the keyway 25, and extends from the side wall surface 207 of the keyway 25. An annular groove 211 is formed to a prescribed depth in the surface of the plug, so as to intersect bore 204. Annular groove 211 serves to prevent a short circuit between fixed contact 42 of one polarity and the key-receiving plug 20 of the opposite polarity, when the plug 20 is rotated by the key 30. An annular groove is also formed to a prescribed depth in the surface of the plug for receiving an O-ring (not shown) for capturing the plug 20 in the cylindrical body.

The cylindrical bore 204 is sized to receive an insulating contact insert, comprised of a dielectric material, such as polycarbonate, and has a spherically contoured outer surface from which extend tabs sized to fit within annular groove 211 of plug 20, so that a contact insert 215 may be captured in bore 204. The contact insert 215 has a cylindrical bore 217 sized to receive a conductive cap 218. A translatable metallic contact 219 is slidably disposed within conductive cap 218 and has a generally spherical solid nipple portion 221 sized to protrude toward the keyway 25. A compression spring 225 is seated between the interior surface of the spherically contoured base portion of the conductive cap 218 and the interior end of metallic contact 219.

The dimensions of these components are such that the nipple portion 221 of translatable contact 219 does not enter the keyway 25, so that translatable contact 219 will not be contacted by the conductive keyblade when the keyblade 31 is inserted into the keyway 25. Instead, the slight protrusion of the nipple portion 221 of translatable contact 219 is such that nipple portion will be physically and electrically engaged by the raised key terminal contact 46, that is insulated and physically offset from the main body of the keyblade 31, by means of insulator layer 48, as shown in FIG. 1.

Thus, when the key 30 is inserted into the keyway 25, the conductive key blade 31 slides through the keyway until the keyblade is fully seated, with pin 113 captured in keyblade detent 123. In this position, the raised terminal contact 46 on the key blade 31 engages translatable contact 219 pushing against the bias of the compression spring 225, so as to provide an electrically conductive path from the insulated raised terminal contact 46, through translatable contact 219, to metallic cap 218.

The metallic cap 218 contacts a fixed metallic contact 42 captured in recess 40 of insulating contact holder 39, which fits within recess 37 of bore 21 of the cylindrical portion 13 of body 10. This recess also receives flex circuit segment 44, which is connected to flex circuit 91, so that a continuous power bus connection is provided by way of the flex circuit structure, that meanders through interior cavities of the lock body. Thus, the flex circuit structure provides a conductive power link for one of the battery terminals, while the metallic body of the lock and the conductive keyblade provide a (ground) link for another battery terminal.

Now although the Eurocylinder-type of electronic key and lock structure described briefly above and detailed in the above-referenced '024 application is readily retrofitted in conventional mechanically actuated Eurocylinder configurations, other types of door lock arrangements, particularly those which integrate the door locking mechanism within the same cylindrical cavity that supports a handle or lever-actuated latch, are not currently configured to allow such a straightforward replacement. As a result, the user of a handle-operated lock/latch mechanism is faced with the prospect of having to modify the physical structure of the door to provide a separate mortise to accommodate the electronic locking mechanism. Instead, however, the user would prefer that modification of the physical structure of the door is unnecessary and that changing the lock would leave the lever-actuated latch intact.

SUMMARY OF THE INVENTION

In accordance with the present invention, these objectives are successfully addressed by a new and improved rose-mounted, handle-operated lock and latch assembly that interfaces the Eurocylinder type of electronic lock, described above, with a rose-accessible door lock/latch mechanism. For this purpose, the present invention employs a handle having the same general configuration as that currently used in a conventional mechanical handle-actuated door latch, but in which the shank portion of the handle is modified to include a cavity that accommodates a Eurocylinder-configured electronic lock. The original rose is replaced by a rose having a slightly larger circular aperture, so that it may receive a rotatable collar that is configured to engage the modified handle shank, whereby the handle and the collar are rotatable relative to the rose, with the cam of the electronic lock being inserted into the door's existing lock spindle mechanism.

The collar not only physically interfaces the modified handle and the rose, but provides an annular passageway sized to accommodate a flex circuit ribbon that extends from the electronic lock through the collar and the rose, the flex circuit ribbon providing the necessary electrical connections between the electronic lock and control circuitry external to the lock. The flex circuit ribbon has a segmented meandering shape, that allows it to form a loop around the lock spindle which is capable of expanding and contracting around the lock spindle as the handle and collar rotate relative to the rose during operation of the door latch.

DETAILED DESCRIPTION

Figure 1:
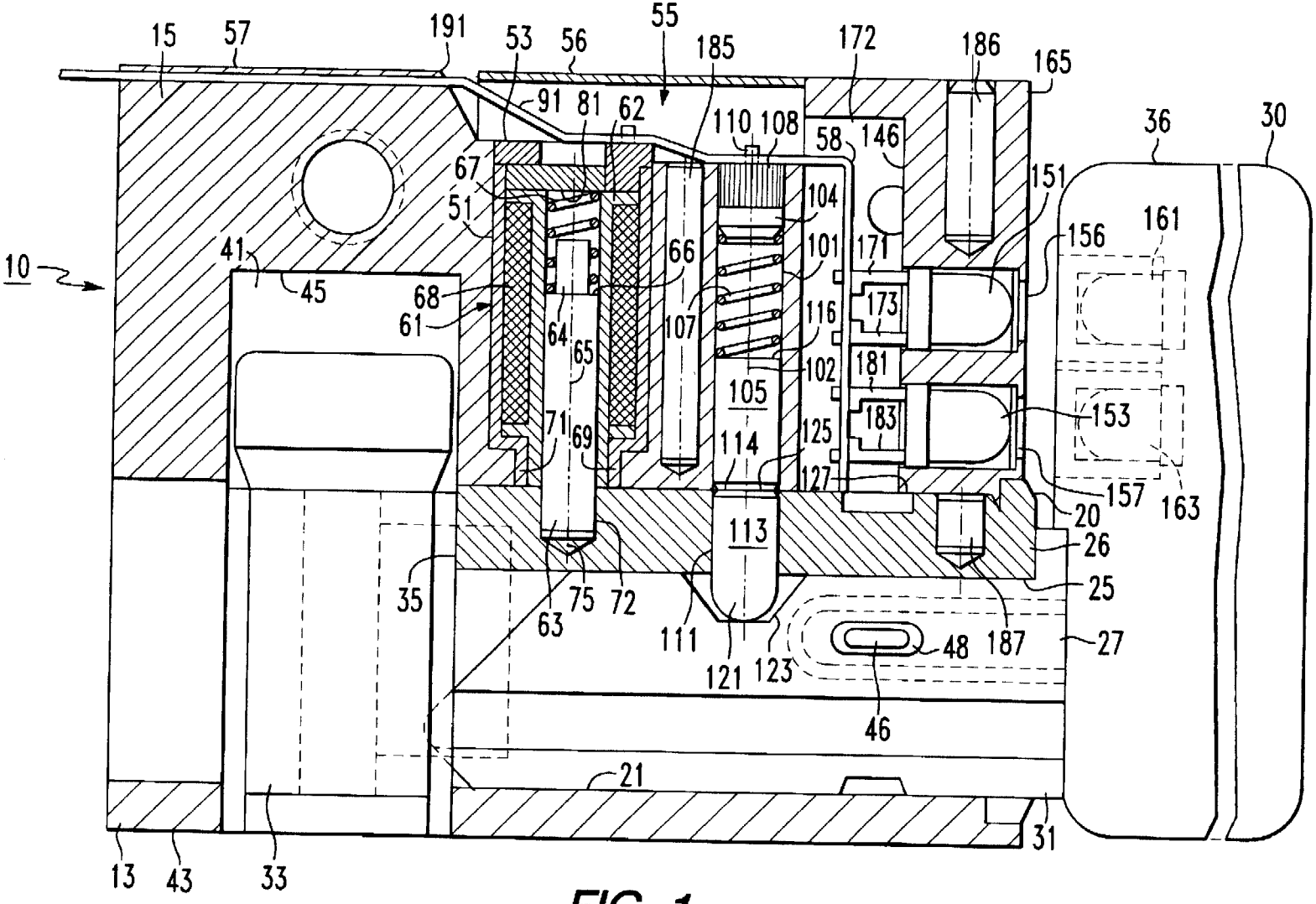
FIG. 1 is a diagrammatic interior side view of a Eurocylinder-conformal electronic lock and key arrangement described in the above-referenced '024 application.

As pointed out briefly above, the handle-mounted lock assembly of the present invention is configured to interface a Eurocylinder type of electronic lock of the type described in the '024 application with a rose-accessible door lock/latch mechanism, that employs a handle or lever for operating the door latch. Such a conventional handle-operated door latch mechanism is diagrammatically illustrated in FIG. 4 as having an exterior lever or handle 401 that is mounted via an exterior rose 403 for rotation about an axis 405, passing through a generally cylindrical cavity 407 in a door 409. The handle 401 engages a lock/latch mechanism, shown generally at 410 as including a cylindrical lock device 412 and an associated latch 414, installed in the cavity 407. Similarly, an interior handle 411 is mounted via an interior rose 403 for rotation about axis 405, and engages lock/latch mechanism 410. When unlocked, via a key (not shown) lock/latch mechanism 410 is operative to translate latch 414 in response to rotation of either of the handles and allow the door to open. Depending upon the type of lock/latch interface employed, when the lock/latch mechanism is locked, however, either the exterior lever 401 cannot be rotated or, if rotatable, does not engage the latch 414.

Figure 5:
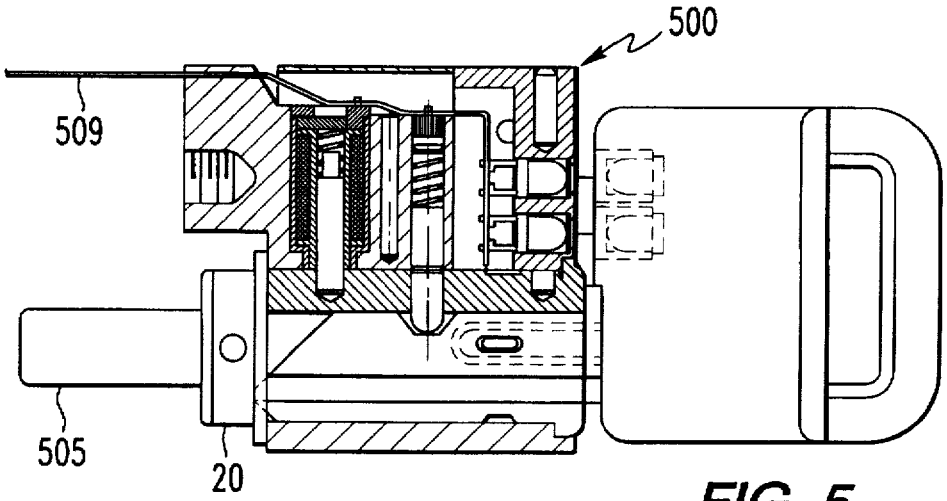
FIG. 5 is a diagrammatic interior side view of a handle-mountable Eurocylinder-conformal electronic key and lock assembly in accordance with an embodiment of the present invention.
Figure 6:
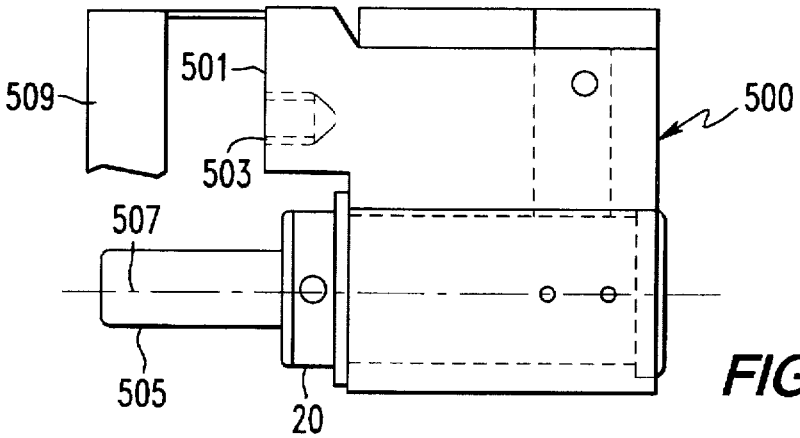
FIG. 6 is a diagrammatic exterior side view of the handle-mountable Eurocylinder-conformal electronic lock assembly of FIG. 5.
Figure 7:
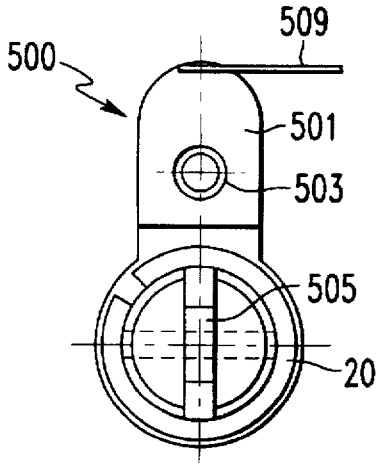
FIG. 7 is a diagrammatic end view of the handle-mountable Eurocylinder-conformal electronic lock assembly of FIG. 5.
Figure 8:
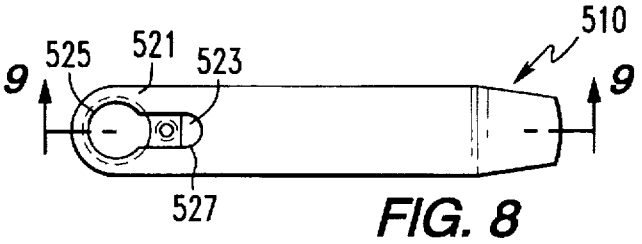
FIG. 8 is a diagrammatic front view of a modified door latch handle in which the Eurocylinder-conformal electronic lock assembly of FIGS. 5–7 is installable.
Figure 12:
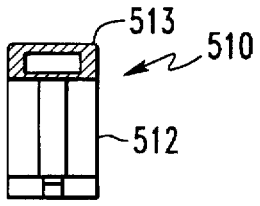
FIG. 12 is a diagrammatic sectional view of the modified door latch handle of FIG. 9, taken along lines 12—12 of FIG. 9.

Referring now to FIGS. 5, 6 and 7, the handle-mountable Eurocylinder-conformal lock cylinder body of the present invention is diagrammatically illustrated at 500 as having the same general configuration as that described in the '024 application. However, in order that the cylinder body 500 may be installed within a cavity provided in the shank portion of a modified door latch handle, shown in FIGS. 8–12, to be described below, a rear or interior wall portion 501 of the cylinder body 500 includes a threaded handle-mounting bore 503; in addition, a cam 505 that extends from the plug 20 is configured to extend generally along the longitudinal axis 507 of the plug and has a generally rectilinear shape that conforms with the shape of a cam-receiving slot of the lock/latch mechanism installed in the door cavity behind the door rose. As an additional alteration, a flex circuit ribbon 509 (which replaces the flex circuit 91 of the configuration of FIGS. 1–3) has a segmented meandering shape, that allows a loop of the flex circuit to expand and contract around the axis of the Eurocylinder's cam as the door handle and an associated collar rotate relative to the rose during operation of the door latch. Otherwise, the components of the electronic Eurocylinder of the '024 application, described above, are essentially unaltered.

Figure 4:
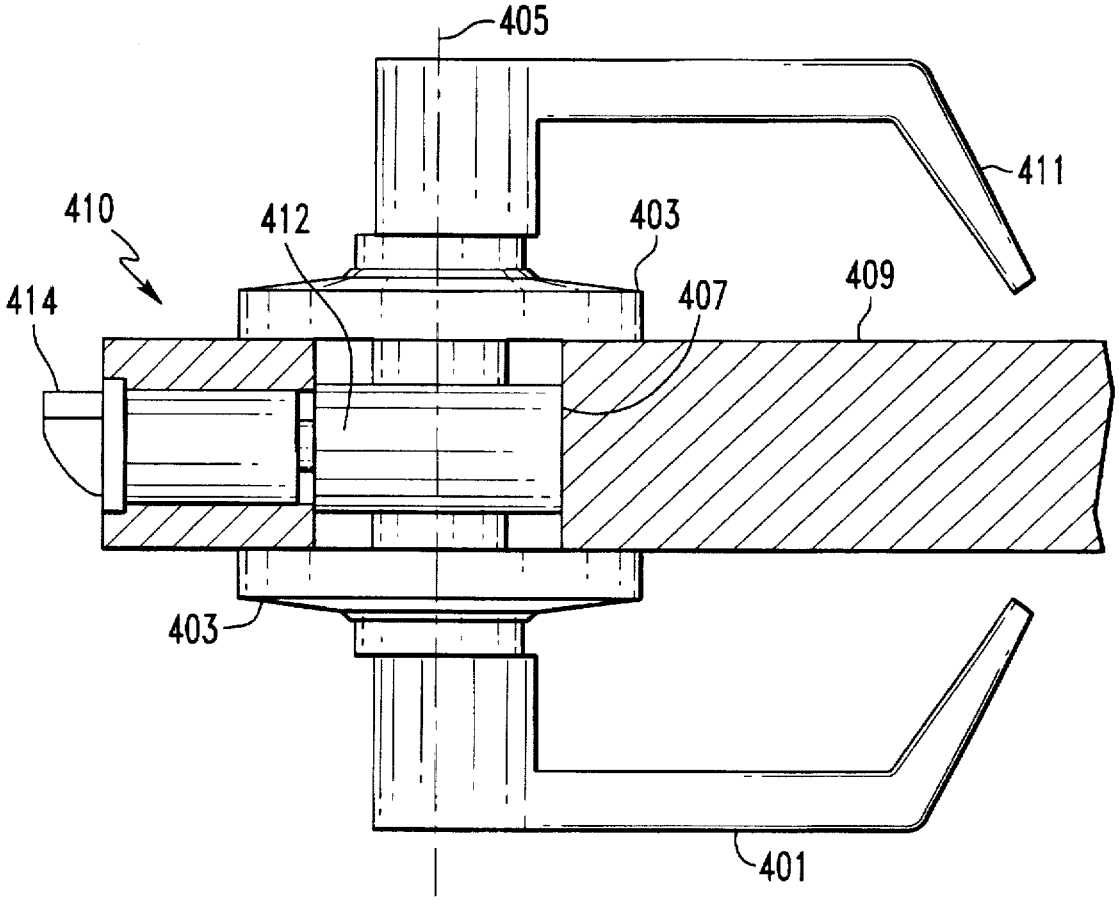
FIG. 4 PRIOR ART
FIG. 4 diagrammatically illustrates a conventional handle-operated door latch/lock mechanism.
Figure 9:
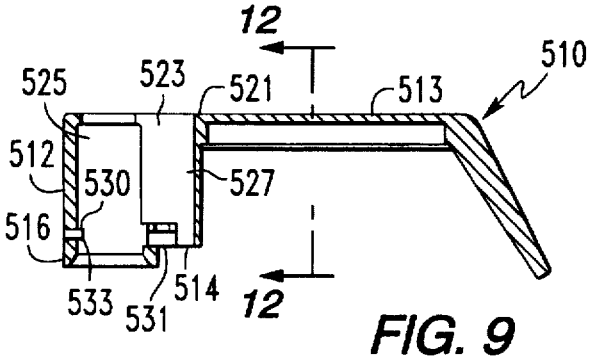
FIG. 9 is a diagrammatic sectional view of the modified door latch handle of FIG. 8, taken along lines 9—9 of FIG. 8.
Figure 11:
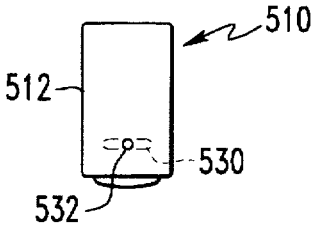
FIG. 11 is a diagrammatic end view of the modified door latch handle of FIG. 8.
Figure 10:
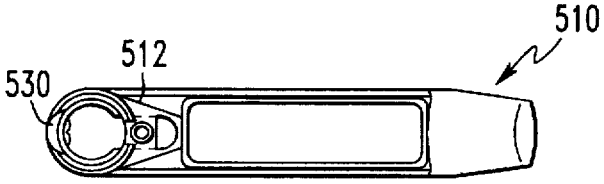
FIG. 10 is a diagrammatic back view of the modified door latch handle of FIG. 8.
Figure 13:
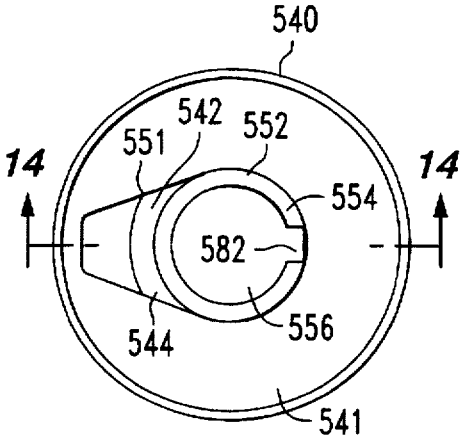
FIG. 13 is a diagrammatic exterior view of a rose interface collar with which the door latch handle of FIGS. 8–12 is mounted.
Figure 14:
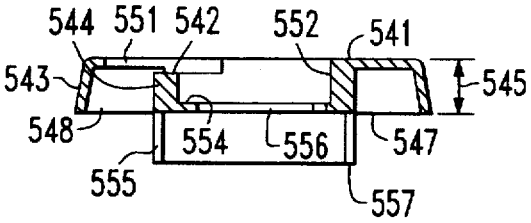
FIG. 14 is a diagrammatic sectional view of the collar of FIG. 13, taken along lines 14—14 of FIG. 13.
Figure 16:
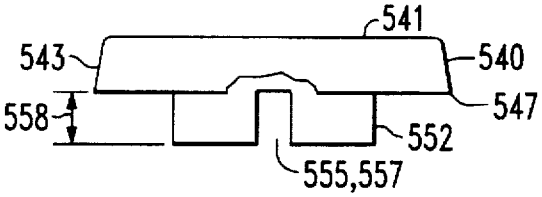
FIG. 16 is a diagrammatic side view of the collar of FIG. 13.
Figure 15:
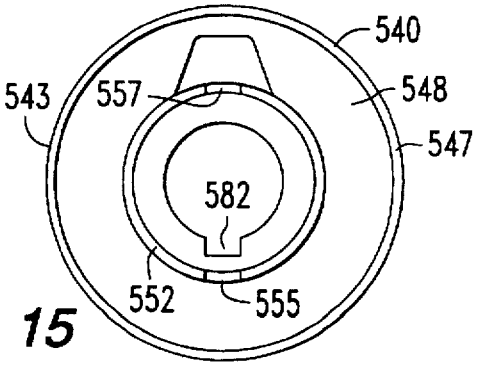
FIG. 15 is a diagrammatic underside view of the collar of FIG. 13.

The manner in which a handle or lever of the type shown in FIG. 4, described above, is configured to accommodate the electronic Eurocylinder lock configuration of FIGS. 5, 6 and 7 is diagrammatically illustrated in FIGS. 8–12. As shown therein, the modified handle 510 has a shank 512 and a lever arm 513 extending from shank 512 and being configured substantially the same as the lever arm of a conventional handle of the type shown in FIG. 4. As shown in FIGS. 9 and 10, the outer surface of shank 512 has a generally V-tapered oval shape, with a generally cylindrical lip portion 516 projecting from a bottom or end surface 514 of the shank 512.

Extending from the top surface 521 of handle 510 into the shank 512 is a cavity 523 that conforms with the shape of the Eurocylinder-conformal lock cylinder body 500 shown in FIGS. 5–7, such that cavity 523 has a generally cylindrical cavity portion 525 and a generally elongated curvilinear portion 527 extending from a side portion of the cylindrical cavity portion 525, such that the generally cylindrical cavity portion 525 conforms with the cylindrical body portion of the lock's cylinder body 500 and the generally elongated curvilinear portion 527 conforms with the generally elongated curvilinear portion 501 of the cylinder body.

Extending inwardly toward elongated curvilinear portion 527 of cavity 523, from the bottom surface 514 of the shank 512, is a bore 531 which is sized to receive a screw fastener that is threadable into the threaded handle-mounting bore 503 in the cylinder body 500, for affixing the Eurocylinder unit 500 of FIGS. 5–7 into the cavity 523. Since the lower or bottom surface 514 of the shank faces the rose and is covered by a collar (to be described) in the handle's installed configuration, access to or tampering with the screw fastener from the door's exterior is prevented, so that the Eurocylinder cannot be removed from the handle.

The generally cylindrical cavity portion 525 also includes an arcuate recess 530, in which a shim 533 is installed for engaging a handle retention element in the existing door hardware. A hole 532 through the sidewall of the shank intersects recess 530, so as to allow access to the shim by the insertion of a tool through the shank wall.

Figure 17:
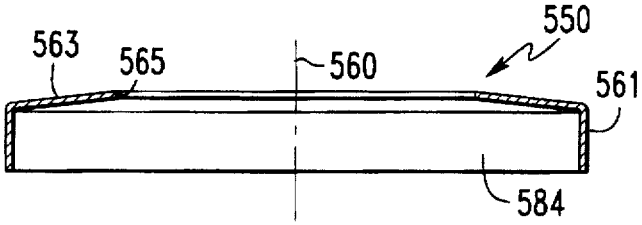
FIG. 17 is a diagrammatic side view of a rose with which the collar of FIGS. 13–16 is mounted.

FIGS. 13–16 diagrammatically illustrate the configuration of a generally circular collar 540, which is mountable with a rose, a diagrammatic side view of which is shown at 550 in FIG. 17, and is configured to receive and be rotatable with the shank 512 of the handle 510. Collar 540 has a circular exterior front face 541 that is surrounded by and solid with a slightly flared annular rim 543 which has a depth 545 to a bottom rim surface 547, that rests upon and is rotatable relative to the rose, as will be described. A generally V-tapered oval depression 551 conforms with the generally V-tapered oval shape of the shank 512 of the handle and extends through the thickness of the front face 541 to the outer surface 542 of an arcuate land portion 544.

A generally cylindrical wall portion 552 of the oval shape of depression 551 extends to a generally ring-shaped floor region 554, so as to leave a generally annular open region 548 between cylindrical wall portion 552 and annular rim 543. Floor region 554 has a circular aperture 556 sized to allow it to pass around a generally cylindrical cam-engaging lock spindle of the lock/latch mechanism installed in the door, and permit the generally rectilinear cam 505 that extends from the plug 20 along longitudinal axis 507 to mate with a corresponding cam-receiving slot within the lock spindle. Intersecting circular aperture 556 in floor region 554 is an indented slot 582 which receives a retaining element of the existing lock/latch hardware installed in the door, as will be described.

The generally cylindrical wall portion 552 of the collar projects beyond the floor region 554 as a generally cylindrical wall portion 552, terminating a distance 558 from the bottom surface 547 of rim 543. Wall portion 552 of collar 540 has a pair of diametrically opposed slots 555 and 557 that are also arranged to be engaged by spring retention members of the lock/latch hardware, as will be described.

As shown in the diagrammatic side view of FIG. 17, rose 550, which is cylindrically symmetric about an axis 560, has a generally cylindrical rim 561 that is solid with a slightly tapered annular exterior surface portion 563. Tapered annular exterior surface portion 563 has a circular aperture 565 that is sized to receive the cylindrical wall portion 552 of the collar 540, so that the bottom rim surface 547 of the collar rests upon tapered annular exterior surface portion 563, and is rotatable with the handle 510 about axis 560.

Figure 2:
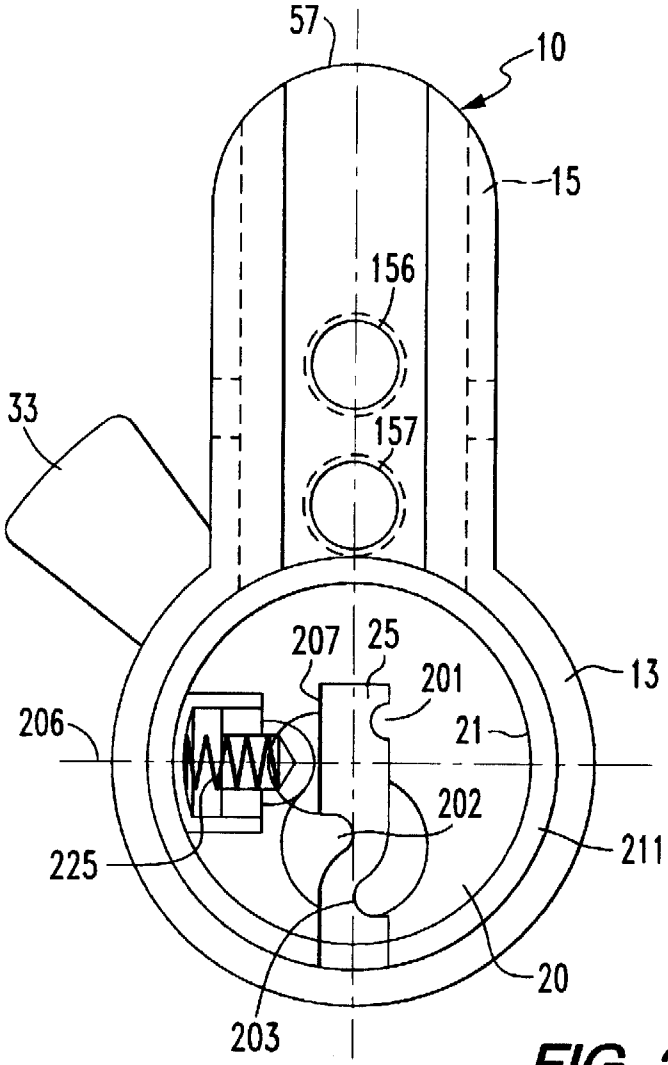
FIG. 2 is a diagrammatic front view of the Eurocylinder-conformal electronic lock assembly shown in FIG. 1.
Figure 3:
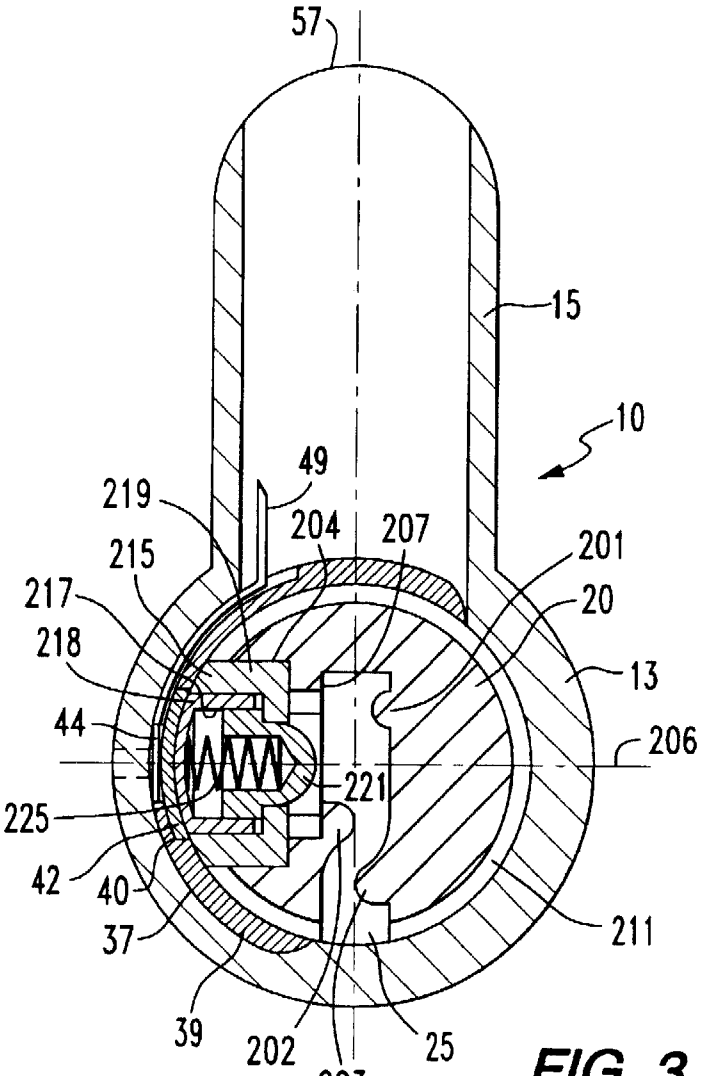
FIG. 3 is a diagrammatic sectional view of the key-engaging contact portion of the Eurocylinder-conformal electronic lock assembly shown in FIG. 1.
Figure 18:
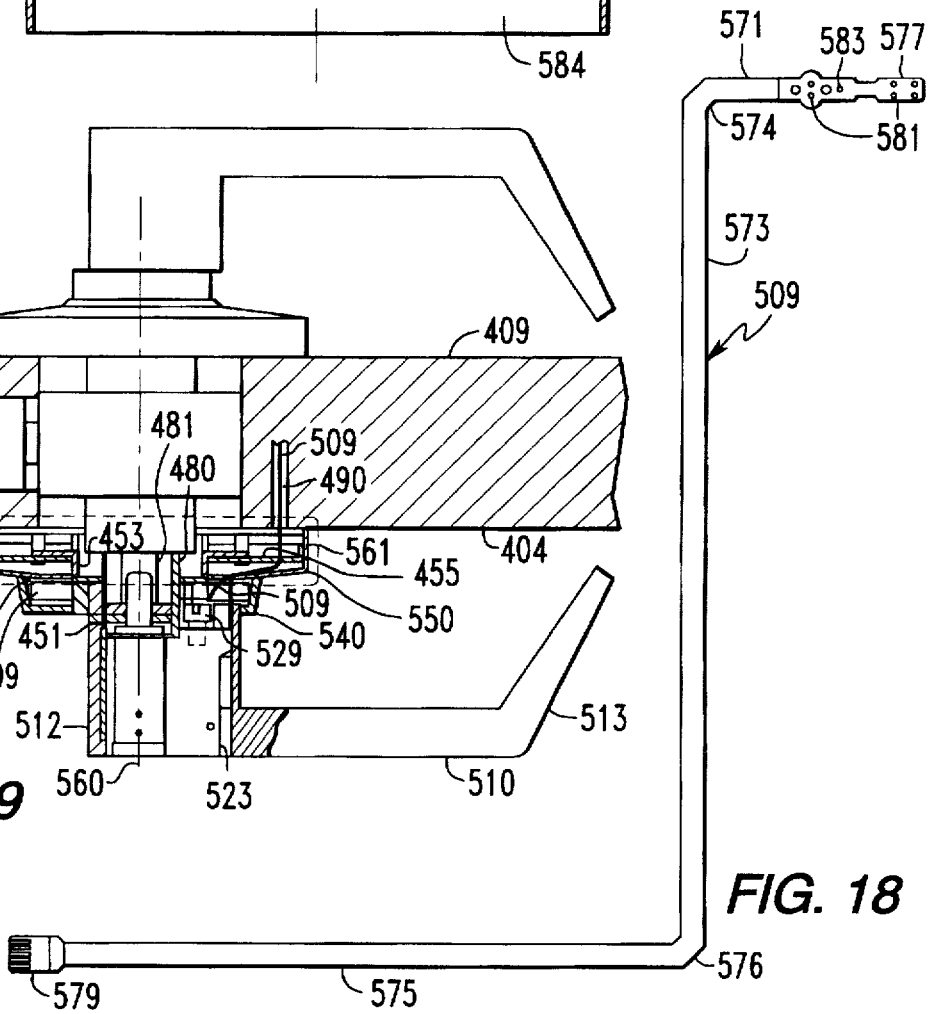
FIG. 18 shows the segmented meandering configuration of flex circuit ribbon.

FIG. 18 shows the segmented meandering configuration of flex circuit ribbon 509, which, as noted briefly above, replaces the generally linear configuration of the flex circuit 91 employed in the Eurocylinder configuration of FIGS. 1–3. Flex circuit 509 is formed of respective segments 571, 573 and 575 of a continuous meandering, generally elongated, thin dielectric strip (e.g. Mylar), in which a plurality of conductive tracks are embedded and extend between respective terminal pads regions 577 and 579 at opposite ends of the flex circuit 509. Distributed at terminal pad region 577 are access holes 581 to allow external connections to be made to the embedded conductor tracks in the flex circuit strip. In addition, a center track of the flex circuit is connected to a pad region shown at 583, in order to provide a power bus connection to an insulated power terminal on the keyblade.

As shown in FIG. 18, the length of flex circuit segment 571 is considerably less than those of segments 573 and 575, segment 571 joining segment 573 at a generally right angle bend 574, and segment 573 joining segment 575 at a generally right angle bend 576. The length of flex circuit segment 571 is sufficient to clear the bottom surface 514 of the handle shank 512 and enter the open interior region of the collar 540. The length of flex circuit segment 573 is sufficient to form a loop that is allow to expand and contract within the open interior region 548 surrounding cylindrical wall portion 552 of the collar 540 as the handle and the collar rotate relative to the rose during operation of the door latch. The length of flex circuit segment 575 is sufficient to extend from an end portion of the looped segment within an open interior region of the rose 550 that communicates with the annular region 548 of collar 540 and pass through the rose 550 and into a communication passageway in the door to control circuitry external to the lock.

Figure 19:
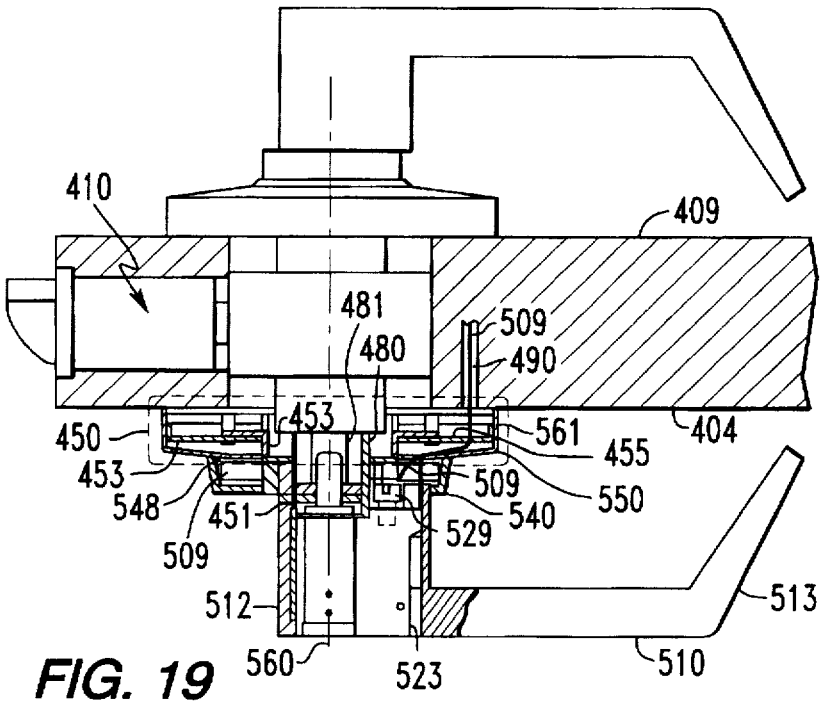
FIG. 19 is a partial sectional view of the overall assembly of the handle-mounted lock assembly, respective components of which are shown in FIGS. 4–18.
Figure 20:
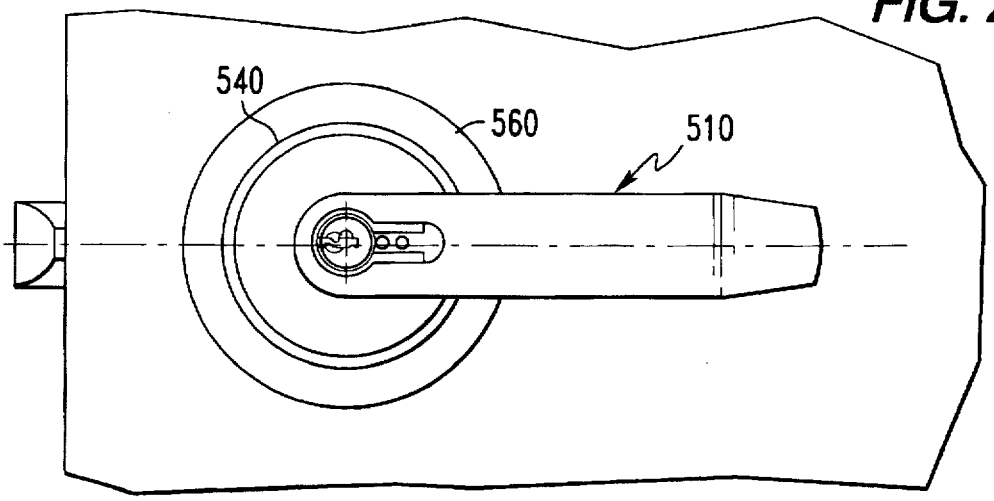
FIG. 20 is a front view of the overall assembly of the handle-mounted lock assembly, respective components of which are shown in FIGS. 4–18.

FIG. 19 is a partial sectional view and FIG. 20 is a front view of the overall assembly of the handle-mounted lock assembly respective components of which are shown in FIGS. 4–18, described above. As shown therein, the Eurocylinder lock configuration 500 is installed in the cavity 523 of the shank 512 of handle 510 by means of a screw fastener 529 which is threaded into the threaded handle-mounting bore 503 in the cylinder body 500. The rim 561 of rose 550 rests against the exterior surface 404 of door 409, so as to provide a shroud for the spring assembly mechanism (surrounded by broken lines 450) of the existing lock/latch mechanism 410.

The bottom rim surface 547 of the collar 540 abuts against the tapered annular exterior surface portion 563 of the rose 550, with the cylindrical wall portion 552 of the collar 540 being inserted through circular aperture 565 of the rose, such that the circular aperture 556 of floor region 554 fits around the generally cylindrical cam-engaging lock spindle 480 of the lock/latch mechanism installed in the door 409. The collar is positioned such that the indented slot 582 in the floor region 554 receives a retaining element 451 of the existing lock/latch hardware and the pair of diametrically opposed slots 555 and 557 are engaged by spring retention members 453 and 455 of the lock/latch hardware installed in the door.

The handle 510 is inserted into the collar 540, such that the generally V-tapered oval shape of the shank 512 of the handle fits within the generally V-tapered oval depression 551 of the collar 540, with the cam 505 mating with a cam-receiving slot 481 within lock spindle 480. Also, the shim 533 within the arcuate recess 531 engages handle retention element 451 extending from the existing door hardware. As mentioned above, and as is shown in FIGS. 19 and 20, in its installed configuration, the bottom surface 514 of the shank 510 facing the rose 550 is covered by collar 540, so the screw fastener 529 cannot be accessed from the door's exterior, thereby preventing removal of the Eurocylinder.

FIG. 19 also shows the manner in which the segmented meandering configuration of flex circuit ribbon 509 is located within the open interior annular region 548 of the collar 540, so that flex circuit segment 573 extends at a right angle from segment 571 and forms an expandable and contractible loop around the lock spindle 480, thereby allowing the flex circuit to accommodate rotation of the handle and the collar relative to the rose during operation of the door latch. The length of flex circuit segment 575 then extends at a further right angle from segment 573 and extends from the segment 575, as looped within an open interior region 584 of the rose 550 that communicates with the annular region 548 of collar 540 and passes through the rose 550 and into a communication passageway shown at 490 in the door 409 to control circuitry external to the lock.

As will be appreciated from the foregoing description, the desirability of installing a Eurocylinder-type of electronic key and lock assembly of the type detailed in the above-referenced '024 application, into a door lock/latch mechanism that integrates the door locking mechanism within the same cylindrical cavity that supports a lever-actuated latch, is successfully addressed by the present invention, which replaces the original handle with one of the same general exterior configuration, but in which the shank accommodates a Eurocylinder-configured electronic lock. The original rose is replaced by a rose having a slightly larger circular aperture, which receives a rotatable collar that is configured to engage the modified handle shank, so that the handle and the collar are rotatable relative to the rose, as the cam of the electronic lock engages the door's existing lock spindle mechanism. The collar both physically interfaces the modified handle and the rose, and also provides an annular passageway sized to accommodate a flex circuit ribbon that provides electrical connections between the electronic lock and control circuitry external to the lock. This assembly makes modification of the physical structure of the door unnecessary and the lever-actuated latch intact. Advantageously, the flex circuit ribbon has a segmented meandering shape, that allows it to form a loop around the lock spindle which is capable of expanding and contracting around the lock spindle, as the handle and collar rotate relative to the rose during operation of the door latch.

While I have shown and described an embodiment in accordance with the present invention, it is to be understood that the same is not limited thereto but is susceptible to numerous changes and modifications as known to a person skilled in the art, and I therefore do not wish to be limited to the details shown and described herein but intend to cover all such changes and modifications as are obvious to one of ordinary skill in the art.

What is claimed:

1. A handle-mounted lock assembly comprising:

an electronic lock;

a handle having a shank and a lever extending from said shank, said shank having a cavity configured to retain therein said electronic lock, said electronic lock having a cam that is configured to engage and operate a rose-accessible door latch mechanism installed in a door behind a rose; and a collar, which is adapted to be mounted with said rose and is configured to receive said shank of said handle and enable said handle to rotate relative to said rose as said cam of said electronic lock engages said rose-accessible door latch mechanism; and further including a flexible interconnect circuit extending from said electronic lock through said collar and adapted to extend through said rose for connection to a control circuit external thereto, wherein said flexible interconnect circuit has a first generally linear portion connected to said electronic lock in said shank of said handle, a second generally linear portion that extends generally transversely from said first generally linear portion and forms a loop around the interior of said collar and is adapted to extend into said rose, and a third generally linear portion that extends generally transversely from said second generally linear portion so that it is adapted to pass from said rose for connection to said control circuit.

2. A handle-mounted lock assembly according to claim 1, wherein said electronic lock comprises a body having a first body portion containing a bore configured to accommodate a rotatable plug, said rotatable plug having a keyway into which an electronic key is insertable for operating said electronic lock, and a second body portion which contains a controlled actuation device for selectively enabling said plug to rotate within said bore, and wherein said controlled actuation device comprises a solenoid device, energization current for which is supplied by way of said flexible interconnect circuit extending from said electronic lock through said collar and adapted to extend through said rose for connection to the control circuit external thereto, said solenoid device having a movable plunger that is translatable to engage said rotatable plug.

3. A handle-mounted lock assembly according to claim 2, wherein said second body portion includes an opto-electronic communication unit having a pair of opto-electronic transmit and receive devices, which are operative to communicate with mutually aligned receive and transmit devices of an opto-electronic communication unit contained within a handle portion of said electronic key.

4. A handle-mounted lock assembly according to claim 3, wherein electrical connections to said pair of opto-electronic transmit and receive devices in said second body portion are provided by way of conductor tracks of said flexible interconnect circuit extending from said electronic lock through said collar and adapted to extend through said rose for connection to the control circuit external thereto.

5. A handle-mounted lock assembly according to claim 3, wherein said bore in said first body portion contains an insulated conductive contact that is coupled to said flexible interconnect circuit and is operative to provide an electrical circuit path between said flexible interconnect circuit extending from said electronic lock through said collar and adapted to extend through said rose for connection to a control circuit external thereto and an insulated terminal on a keyblade of said electronic key.

6. A handle-mounted lock assembly according to claim 5, wherein said insulated conductive contact is configured to be electrically engaged by a raised key terminal contact that is insulated and physically offset from a main body portion of said keyblade, so that when said key is inserted into said keyway, an electrical circuit path is provided between said raised key terminal contact on said key blade and said insulated conductive contact in said bore.

7. A handle-mounted lock assembly comprising:

an electronic lock;

a handle having a shank and a lever extending from said shank, said shank having a cavity configured to retain therein said electronic lock, said electronic lock having a cam that is configured to engage and operate a rose-accessible door latch mechanism installed in a door behind a rose; and a collar, which is adapted to be mounted with said rose and is configured to receive said shank of said handle and enable said handle to rotate relative to said rose as said cam of said electronic lock engages said rose-accessible door latch mechanism, and wherein said collar has a circular exterior front face that is surrounded by and is solid with an annular rim thereof that is adapted to abut and be rotatable relative to said rose, said collar further including a depression that conforms with a shape of said shank of said handle, and a generally cylindrical wall portion sized to pass around a lock spindle mechanism of said door latch mechanism and permit said cam of said electronic lock to engage said lock spindle mechanism.

8. A handle-mounted lock assembly according to claim 7, wherein said generally cylindrical wall portion of said collar extends beyond said annular rim, so as to be adapted to enter into an aperture in said rose and engage spring retention members of said door latch mechanism.

9. A handle-mounted lock assembly according to claim 8, further including a flexible interconnect circuit extending from said electronic lock through said collar and adapted to extend through said rose for connection to a control circuit external thereto.

10. A handle-mounted lock assembly according to claim 9, wherein said flexible interconnect circuit has a meandering shape, so that it may pass from said electronic lock in said shank of said handle through said collar and is adapted to pass through said rose, while allowing rotation of said handle and said collar relative to said rose.

11. A handle-mounted lock assembly according to claim 10, wherein said shank has a shank bore that extends inwardly toward said cavity from a bottom surface of said shank, said shank bore being sized to receive a fastener for affixing said electronic lock in said cavity, such that said bottom surface of said shank is adapted to face said rose and is covered by said collar, thereby preventing access to said fastener from the door's exterior.

12. A handle-mounted lock assembly according to claim 11, wherein said flexible interconnect circuit is formed of respective segments of a continuous meandering, generally elongated, thin dielectric strip containing a plurality of conductive tracks that extend between terminal regions at opposite ends of said flexible interconnect circuit and provide electrical connections to said conductor tracks in said flexible interconnect circuit, said segments forming a loop that expands and contracts within an interior region of said collar surrounding said cylindrical wall portion of said collar as said handle and collar rotate relative to said rose during operation of said door latch mechanism.

13. A handle-mounted lock assembly according to claim 12, wherein said electronic lock comprises a body having a first body portion containing a bore configured to accommodate a rotatable plug, said rotatable plug having a keyway into which an electronic key is insertable for operating said electronic lock, and a second body portion which contains a controlled actuation device for selectively enabling said plug to rotate within said bore.

14. A handle-mounted lock assembly according to claim 13, wherein said controlled actuation device comprises a solenoid device, energization current for which is supplied by way of said flexible interconnect circuit, said solenoid device having a movable plunger that is translatable to engage said rotatable plug.

15. A handle-mounted lock assembly according to claim 14, wherein said second body portion includes an opto-electronic communication unit having a pair of opto-electronic transmit and receive devices, which are operative to communicate with mutually aligned receive and transmit devices of an opto-electronic communication unit contained within a handle portion of said electronic key.

16. A handle-mounted lock assembly according to claim 15, wherein electrical connections to said pair of opto-electronic transmit and receive devices in said second body portion are provided by way of conductor tracks of said flexible interconnect circuit.

17. A handle-mounted lock assembly according to claim 16, wherein said bore in said first body portion contains an insulated conductive contact that is coupled to said flexible interconnect circuit and is operative to provide an electrical circuit path between said flexible interconnect circuit and an insulated terminal on a keyblade of said electronic key.

18. A handle-mounted lock assembly according to claim 17, wherein said insulated conductive contact is configured to be electrically engaged by a raised key terminal contact that is insulated and physically offset from a main body portion of said keyblade, so that when said key is inserted into said keyway, an electrical circuit path is provided between said raised key terminal contact on said key blade and said insulated conductive contact in said bore.

19. A handle-mounted lock assembly comprising a Eurocylinder-configured electronic lock, a handle having a lever extending from a shank containing a cavity in which said Eurocylinder-configured electronic lock is installed from a bottom portion of said shank by means of a fastener into said Eurocylinder-configured electronic lock, a rose adapted to abut against an exterior surface of a door so as to provide a shroud for a spring assembly mechanism of a door latch mechanism installed in said door behind said rose, a collar having a bottom rim that abuts against said rose, and a cylindrical wall portion that passes through an aperture of said rose, such that said cylindrical wall portion of said collar is adapted to surround a cam-engaging lock spindle of said door latch mechanism installed in said door, said cylindrical wall portion of said collar being adapted to engage spring retention members of said door latch mechanism in said door, said shank fitting within a depression in said collar to allow a cam of said Eurocylinder-configured electronic lock retained in said shank cavity to be coupled with said lock spindle, so that said bottom portion of said shank faces said rose and is covered by said collar, thereby preventing said fastener from being accessed from the door's exterior, and a flexible interconnect circuit extending from said electronic lock through said collar and said rose for connection to a control circuit external thereto, said flexible interconnect circuit having a meandering shape passing from said electronic lock in said shank of said handle through said collar and said rose, while allowing rotation of said handle and said collar relative to said rose.

20. A handle-mounted lock assembly according to claim 19, wherein said flexible interconnect circuit is formed of respective segments of a continuous meandering, generally elongated, thin dielectric strip containing a plurality of conductive tracks that extend between terminal regions at opposite ends of said flexible interconnect circuit and provide electrical connections to said conductor tracks in said flexible interconnect circuit, said segments forming a loop that expands and contracts within an interior region of said collar surrounding said cylindrical wall portion of said collar as said handle and collar rotate relative to said rose during operation of said door latch mechanism.

* * * * *